US008506336B2

(12) United States Patent
Oh

(10) Patent No.: US 8,506,336 B2
(45) Date of Patent: Aug. 13, 2013

(54) STAMPED AND FORMED CONTACT

(75) Inventor: Lawrence Se-Jun Oh, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/224,974

(22) Filed: Sep. 2, 2011

(65) Prior Publication Data

US 2013/0059485 A1 Mar. 7, 2013

(51) Int. Cl.
*H01R 11/22* (2006.01)

(52) U.S. Cl.
USPC ..... 439/852; 439/843

(58) Field of Classification Search
USPC ..... 439/374, 376, 378, 842, 843, 849–856
See application file for complete search history.

(56) References Cited

U.S. PATENT DOCUMENTS

| | | | | |
|---|---|---|---|---|
| 4,278,317 | A * | 7/1981 | Gallusser et al. | 439/744 |
| 4,447,110 | A * | 5/1984 | Punako et al. | 439/843 |
| 4,660,911 | A | 4/1987 | Reynolds et al. | |
| 4,666,227 | A * | 5/1987 | Galizia et al. | 439/252 |
| 4,804,339 | A | 2/1989 | Cohen | |
| 4,969,829 | A | 11/1990 | Sato | |
| 4,997,376 | A | 3/1991 | Buck et al. | |
| 5,064,391 | A | 11/1991 | Buchter | |
| 5,145,383 | A | 9/1992 | Bowen et al. | |
| 5,529,517 | A * | 6/1996 | Hopf et al. | 439/843 |
| 5,692,928 | A | 12/1997 | Nelson et al. | |
| 5,931,686 | A | 8/1999 | Sasaki et al. | |
| 5,951,339 | A * | 9/1999 | Chaillot et al. | 439/852 |
| 6,045,415 | A * | 4/2000 | May et al. | 439/852 |
| 6,095,874 | A * | 8/2000 | Quaranta | 439/852 |
| 6,261,132 | B1 | 7/2001 | Koseki et al. | |
| 6,358,104 | B2 * | 3/2002 | Daugherty et al. | 439/851 |
| 6,811,449 | B2 | 11/2004 | Yamashita | |
| 7,033,229 | B2 | 4/2006 | Tsuchiya | |
| 7,249,983 | B2 * | 7/2007 | Meyer et al. | 439/878 |
| 7,458,828 | B2 | 12/2008 | Pavlovic | |
| 7,547,232 | B2 * | 6/2009 | Johannes et al. | 439/620.07 |
| 7,717,759 | B2 * | 5/2010 | Ishigami | 439/851 |
| 7,722,413 | B2 | 5/2010 | Tonosaki | |
| 2005/0266728 | A1 | 12/2005 | Houtz | |
| 2010/0311278 | A1 | 12/2010 | McAlonis et al. | |
| 2010/0311282 | A1 | 12/2010 | Hogan et al. | |

FOREIGN PATENT DOCUMENTS

| | | |
|---|---|---|
| DE | 2643158 | 9/1977 |
| EP | 0 767 513 A1 | 4/1997 |
| EP | 0 767 514 A1 | 4/1997 |
| EP | 0866521 | 9/1998 |
| EP | 0 896 390 A2 | 2/1999 |
| EP | 1 724 878 A2 | 11/2006 |
| GB | 2024539 | 1/1980 |

OTHER PUBLICATIONS

International Search Report, International Application No. PCT/2012/050863, International Filing Date, Aug. 15, 2012.

* cited by examiner

*Primary Examiner* — Thanh Tam Le

(57) ABSTRACT

A high-reliability contact includes a termination portion configured to receive a wire. A mating portion is formed integrally with the termination portion. The mating portion has edges. The mating portion is stamped and formed so that the edges are rolled together to form a mating barrel having a longitudinal axis. The mating barrel is configured to receive a corresponding contact. At least one contact finger is formed in the mating barrel. The at least contact finger extends into the mating barrel toward the longitudinal axis to facilitate contacting the corresponding contact. A contact hood is formed at a distal end of the mating portion to facilitate protecting the at least one contact finger when the mating portion is coupled to the corresponding contact.

17 Claims, 5 Drawing Sheets

STAMPED AND FORMED CONTACT

BACKGROUND OF THE INVENTION

The subject matter described herein relates generally to electrical connectors.

Electrical connectors used in military, missile, satellite and aircraft applications, or the like, generally require high-reliability industrial parts. For example, connectors conforming with Aeronautical Radio, Inc. ("ARINC") generally require high-reliability contacts. High-reliability contacts are formed to withstand high temperatures, vibrations, shock, and the like that are experienced by electrical parts used in military, missile, satellite and aircraft applications, or the like. Generally, high-reliability contacts are screw-machined. In particular, the contact is formed as a solid piece and openings in the contact are drilled in the mating end and termination end thereof. The mating end of the contact is then sliced to form a pair of beams that are configured to mate with a corresponding contact. In some applications, the beams are annealed and bent inward to provide a contact force on the corresponding contact. A hood is then placed over the mating end of the contact to provide stability and smooth edges for mating with the corresponding contact.

However, conventional high-reliability contacts are not without their disadvantages. Typically, the screw-machining process requires a substantial amount of time. For example, screw-machining may only be capable of producing 200 contacts per hour. Additionally, the contacts must be gold-plated in a tank that plates the entire contact. The process of gold-plating the contact adds additional manufacturing time and costs. Further, most conventional high-reliability contacts require a hood that further adds to manufacturing costs and time. Moreover, a screw-machined contact typically has a greater weight than a stamped and formed contact. In military, missile, satellite and aircraft applications, even a nominal amount of weight may significantly add to operation costs.

A need remains for a high-reliability contact that can be manufactured in a cost effective and reliable manner.

SUMMARY OF THE INVENTION

In one embodiment, a high-reliability contact is provided having a termination portion configured to receive a wire. A mating portion is formed integrally with the termination portion. The mating portion has edges. The mating portion is stamped and formed so that the edges are rolled together at a seam to form a mating barrel having a longitudinal axis. The mating barrel is configured to receive a corresponding contact. At least one contact finger is formed in the mating barrel. The at least contact finger extends into the mating barrel toward the longitudinal axis to facilitate contacting the corresponding contact. A contact hood is formed at a distal end of the mating portion to facilitate protecting the at least one contact finger when the mating portion is coupled to the corresponding contact.

In another embodiment, a high-reliability contact is provided having a mating portion configured to receive a corresponding contact. A termination portion is formed integrally with the mating portion. The termination portion has edges. The termination portion is stamped and formed so that the edges are rolled together at a seam to form a termination barrel having a longitudinal axis. The termination barrel is configured to receive a wire. The termination barrel is configured to be indent crimped to the wire using an indent crimper.

In another embodiment, a high-reliability contact is provided having a termination portion having edges. The termination portion is stamped and formed so that the edges are rolled together at a seam to form a termination barrel having a longitudinal axis. The termination barrel is configured to receive a wire. The termination barrel is configured to be indent crimped to the wire using an indent crimper. A mating portion is formed integrally with the termination portion. The mating portion has edges. The mating portion is stamped and formed so that the edges are rolled together at a seam to form a mating barrel having a longitudinal axis extending along the longitudinal axis of the termination portion. The mating barrel is configured to receive a corresponding contact. At least one contact finger is formed in the mating barrel. The at least contact finger extends into the mating barrel toward the longitudinal axis of the mating barrel to facilitate contacting the corresponding contact. A contact hood is formed at a distal end of the mating portion forward of the at least one contact finger. The contact hood is configured to be mated to the corresponding contact prior to the at least one contact finger.

BRIEF DESCRIPTION OF THE DRAWINGS

The presently disclosed subject matter will be better understood from reading the following description of non-limiting embodiments, with reference to the attached drawings, wherein below.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Embodiments described herein include a high-reliability contact that is stamped and formed. The contact is capable of being produced at a rate of approximately 3000-5000 contacts per hours. Additionally, the contact requires less cost to manufacture because the contact may be gold-plated only at its tip. Further, the contact does not require an additional hood, but rather incorporates the advantages of a hood into the formation of a mating barrel of the contact. The contact requires less material and has a reduced weight in comparison to machined contacts, thereby reducing manufacturing costs and operation costs when used in military, missile, satellite and aircraft applications, or the like. Additionally, the stamped and formed contact is capable of being crimped to a wire using military standard indent crimpers.

Figure 1:
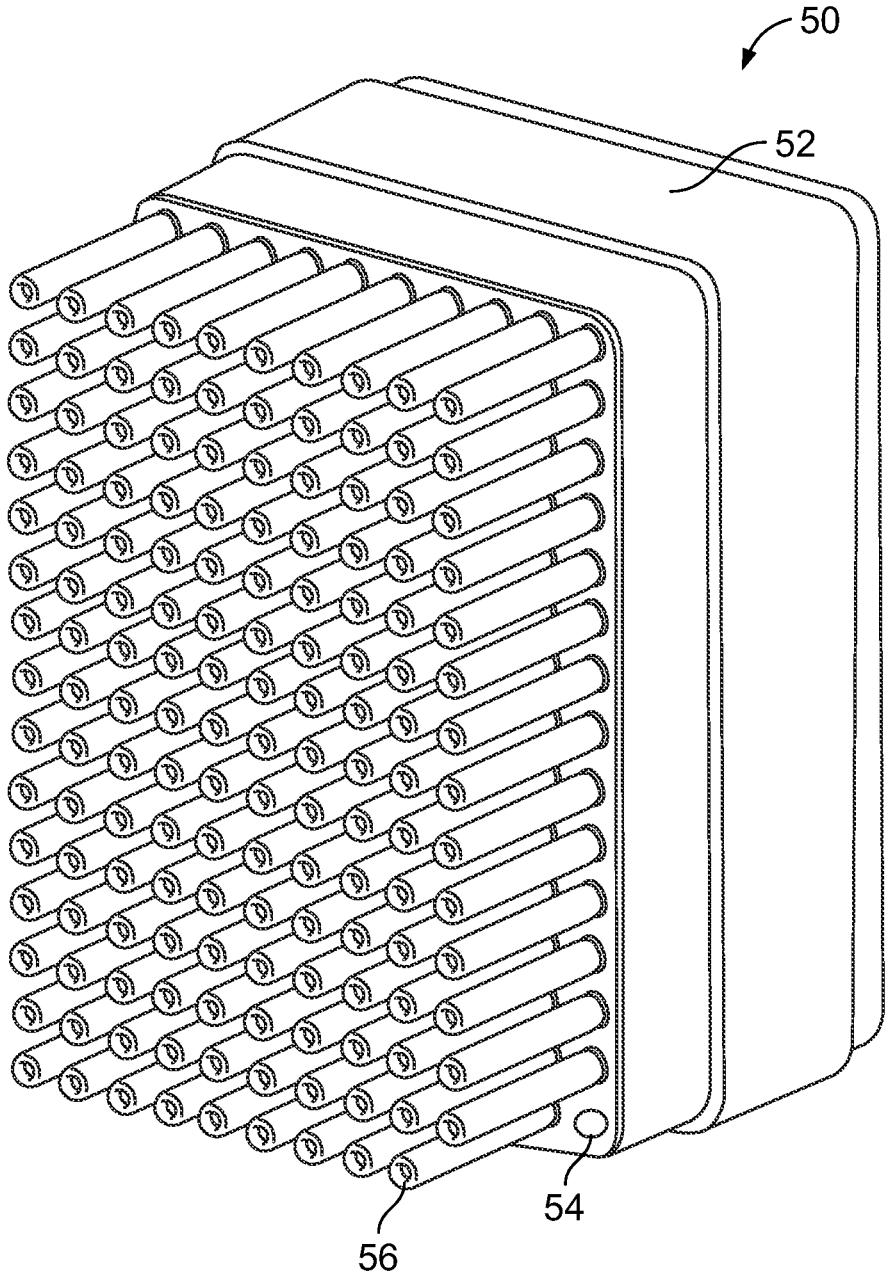
FIG. 1 is a perspective view of a connector formed in accordance with an embodiment.

FIG. 1 is a perspective view of a connector 50 formed in accordance with an embodiment. The connector 50 includes a body 52 having a plurality of cavities 54. Electrical contacts 56 are inserted into the cavities 54. The contacts 56 are high-reliability contacts that have been stamped and formed. The contacts 56 are formed for use in applications that require contact durability, for example, military, aircraft, satellite, and missile applications, or the like. The contacts 56 are configured to withstand high temperatures, high amounts of shock and vibration, and the like. The contacts 56 are formed from a conductive material, for example, copper. After forming the contacts 56, at least a portion of the contact 56 is covered with a gold plating layer to inhibit corrosion and therefore improve the current carrying capability of the contact 56.

Figure 2:
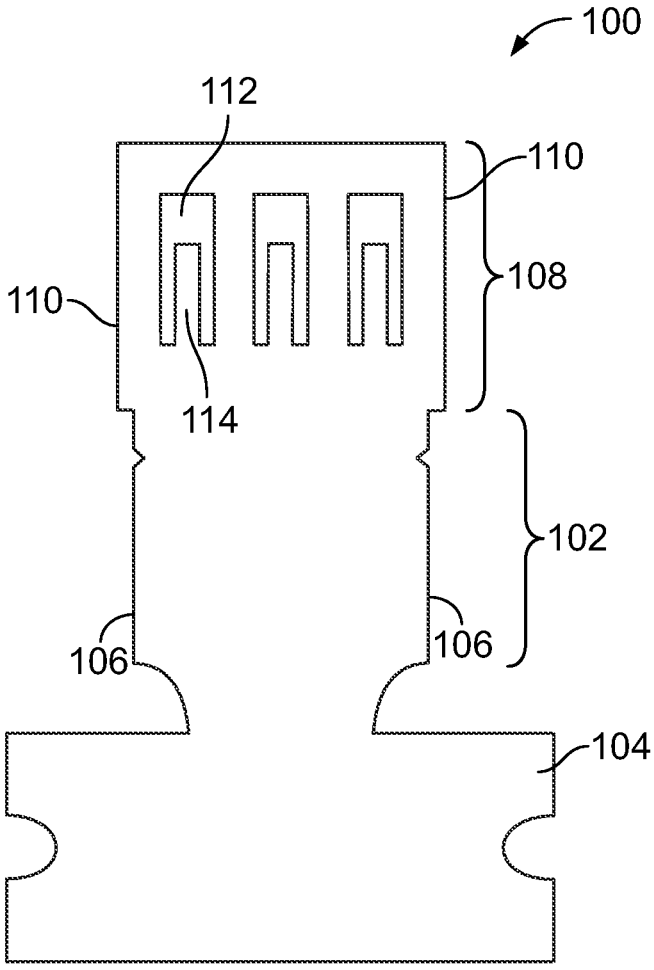
FIG. 2 is a plan view of a high-reliability female contact formed in accordance with an embodiment and in a stamped configuration.
Figure 3:
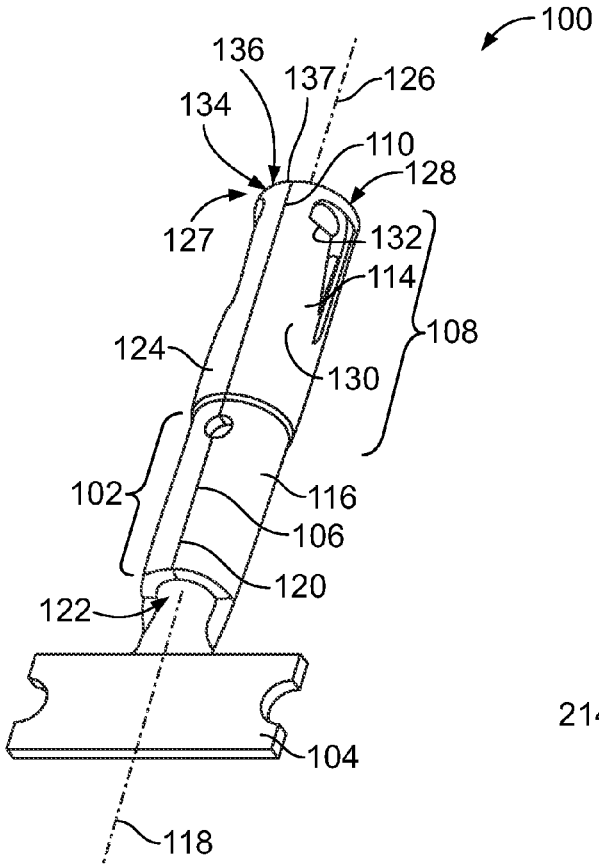
FIG. 3 is a perspective view of the high-reliability female contact shown in FIG. 2 and in a formed configuration.

FIG. 2 is a plan view of the high-reliability female contact 100 in a stamped configuration. The contact 100 may be used in place of the contact 56 shown in FIG. 1. The contact 100 is stamped from a conductive material, for example, copper. The contact 100 includes a termination portion 102 joined to a carrier strip 104. Although FIG. 2 illustrates only one contact 100 joined to the carrier strip 104, any number of contacts 100 may be formed on the carrier strip 104. The termination portion 102 includes opposite edges 106 that are configured to be positioned in contact with one another when the contact 100 is formed, as shown in FIG. 3. A mating portion 108 extends from and is formed integrally with the termination portion 102. The mating portion 108 includes edges 110 that are configured to be positioned in contact with one another when the contact 100 is formed, as shown in FIG. 3.

Contact finger openings 112 are formed in the mating portion 108 of the contact 100. Each contact finger opening 112 includes a contact finger 114 extending therethrough. The illustrated embodiment includes three contact finger openings 112 and three corresponding contact fingers 114. The mating portion 108 of the contact 100 may include any number of contact finger openings 112 and corresponding contact fingers 114 in alternative embodiments.

FIG. 3 is a perspective view of the high-reliability female contact 100 in a formed configuration. The edges 106 of the termination portion 102 are rolled together to form a termination barrel 116. The termination barrel 116 has a longitudinal axis 118 extending therethrough. A seam 120 extends along the termination barrel 116 between the edges 106 of the termination portion 102. In one embodiment, the seam 120 may be sealed by welding, for example, laser welding, or the like. An opening 122 extends through the termination barrel 116 along the longitudinal axis 118. The termination barrel 116 is configured to receive a wire (not shown) in the opening 122. The termination barrel 116 is configured to be annealed and indent crimped to the wire using an indent crimper. For example, the termination barrel 116 may be indent crimped using a 4/8 indent crimper.

In the illustrated embodiment, only one contact 100 is joined to the carrier strip 104. In an exemplary embodiment, multiple contacts 100 are joined to the carrier strip 104. Each of the multiple contacts 100 may be joined to a corresponding wire while joined to the carrier strip 104. The multiple contacts 100 may be crimped to the corresponding wires while joined to the carrier strip 104.

The mating portion 108 extends from the termination portion 102. The edges 110 of the mating portion 108 are rolled together to form a mating barrel 124 having a longitudinal axis 126 and a circumference 127. The longitudinal axis 126 of the mating barrel 124 extends along the longitudinal axis 118 of the termination barrel 116. Alternatively, the longitudinal axis 126 of the mating barrel 124 and the longitudinal axis 118 of the termination barrel 116 may be parallel and offset. In yet another embodiment, the longitudinal axis 126 of the mating barrel 124 and the longitudinal axis 118 of the termination barrel 116 may be non-parallel to one another. The mating barrel 124 includes an opening 128 extending therethrough along the longitudinal axis 126. The mating barrel 124 is configured to receive a corresponding male contact 200 (shown in FIGS. 4 and 5) in the opening 128.

The contact fingers 114 are formed to extend into the mating barrel 124 toward the longitudinal axis 126 to facilitate contacting the contact 200. Each contact finger 114 includes a fixed end 130 and a contact end 132. The fixed end 130 is secured to and formed integrally with the mating barrel 124. The contact fingers 114 extend toward the longitudinal axis 126 of the mating barrel 124 so that the contact end 132 is positioned within the mating barrel 124. In particular, the contact end 132 is positioned closer to the longitudinal axis 126 than the circumference 127 of the mating barrel 124. The contact end 132 is configured to mate with the contact 200. In the illustrated embodiment, the contact end 132 is rounded to facilitate mating with the contact 200 without stubbing the contact finger 114.

In the illustrated embodiment, the contact 100 includes three contact fingers 114. Alternatively, the contact 100 may include any number of contact fingers 114. Increasing the number of contact fingers 114 increases the number of connections with the contact 200 to provide redundancy in the connections between the contact 100 and the contact 200. The redundancy may improve the performance of the contact 100, for example, by reducing an amount of heat generated within the contact 100 and the contact 200.

A contact hood 134 is formed at a tip 136 at a distal end of the mating barrel 124. The contact hood 134 is integral with the other portions of the contact 100. The contact hood 134 extends along the circumference 127 of the mating barrel 124. The contact hood 134 is positioned forward of the contact fingers 114. The contact hood 134 includes a smooth surface 137 to facilitate protecting the contact fingers 114 when the contact 100 is coupled to the contact 200. For example, the smooth surface 137 guides the contact 200 into the opening 128. The smooth surface 137 facilitates preventing stubbing of the contact fingers 114 when the contact 200 is received in the opening 128.

After formation of the contact 100, the tip 136 of the mating barrel 124 may be covered with a gold plating layer to inhibit corrosion and therefore improve the current carrying capability of the contact 100. In an exemplary embodiment, only the tip 136 of the mating barrel 124 is required to be covered in gold, thereby reducing manufacturing time and costs. The contact 100 may be gold plated while joined to the carrier strip 104 with multiple contacts 100. Accordingly, the multiple contacts 100 may be gold-plated concurrently. In one embodiment, the contact ends 132 of the contact fingers 114 may also be gold-plated. After gold-plating the contacts 100, the multiple contacts 100 connected to the carrier strip 104 may be concurrently inserted into the cavities 54 in the connector body 52 (both shown in FIG. 1).

Figure 4:
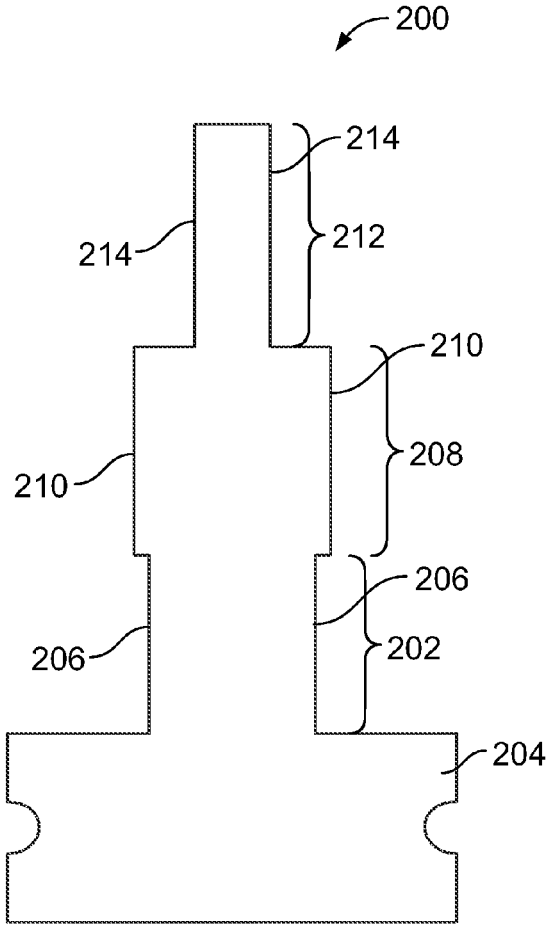
FIG. 4 is plan a view of a high-reliability male contact formed in accordance with an embodiment and in a stamped configuration.

FIG. 4 is a plan view of a high-reliability male contact 200 in a stamped configuration. The contact 200 may be used in place of the contact 56 shown in FIG. 1. The contact 200 is stamped from a conductive material, for example, copper. The contact 200 includes a termination portion 202 joined to a carrier strip 204. Although the illustrated embodiment includes only one contact 200 joined to the carrier strip 204, any number of contacts 200 may be stamped and formed on the carrier strip 204. The termination portion 202 includes edges 206 that are configured to be positioned in contact with one another when the contact 200 is formed. An intermediate portion 208 extends from and is formed integrally with the termination portion 202. The intermediate portion 208 includes edges 210 that are configured to be positioned in contact with one another when the contact 200 is formed. A mating portion 212 extends from and is formed integrally with the intermediate portion 208. The mating portion 212 includes edges 214 that are configured to be positioned in contact with one another when the contact 200 is formed.

Figure 5:
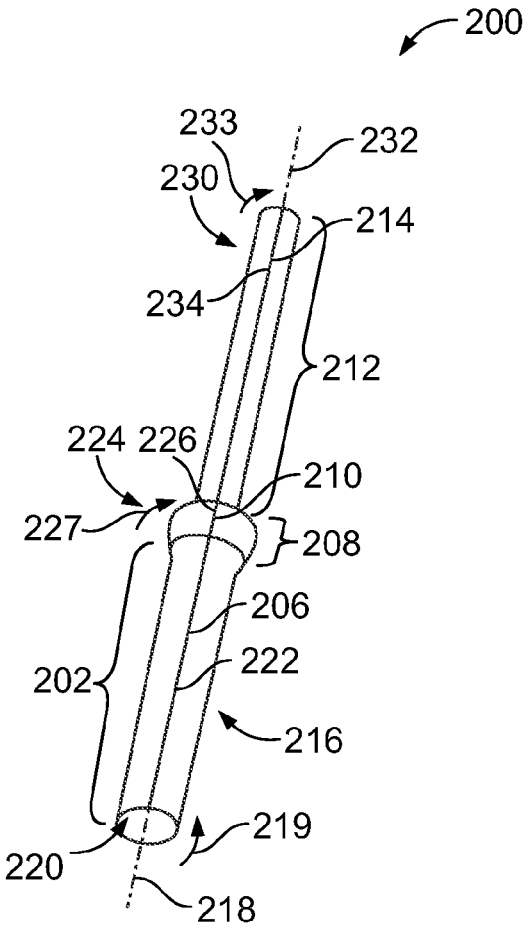
FIG. 5 is a perspective view of the high-reliability male contact shown in FIG. 4 and in a formed configuration.

FIG. 5 is a perspective view of the contact 200 in a formed configuration. The termination portion 202 is rolled so that the edges 206 of the termination portion 202 are in contact with one another. The termination portion 202 is rolled into a termination barrel 216 having a longitudinal axis 218 and a circumference 219. The termination barrel 216 includes an opening 220 extending therethrough along the longitudinal axis 218. The opening 220 is configured to receive a wire (not shown). The termination barrel 216 is configured to be indent crimped to the wire, for example, using a 4/8 indent crimper. In one embodiment, a seam 222 formed between the edges 206 of the termination portion 202 is welded, for example, laser welded, before the termination barrel 216 is indent crimped to the wire. The contact 200 may be one of multiple contacts 200 formed on the carrier strip 204. Accordingly, the termination barrels 216 of the multiple contacts 200 may be crimped to corresponding wires while joined to the carrier strip 204.

The intermediate portion 208 is rolled so that the edges 210 of the intermediate portion 208 are in contact with one another. The intermediate portion 208 is rolled into an intermediate barrel 224 having a longitudinal axis 226 and a circumference 227. The longitudinal axis 226 of the intermediate barrel 224 may extend along the longitudinal axis 218 of the termination barrel 216. Optionally, the longitudinal axis 226 of the intermediate barrel 224 may extend parallel to but be offset from the longitudinal axis 218 of the termination barrel 216. In another embodiment, the longitudinal axis 226 of the intermediate barrel 224 may be non-parallel with respect to the longitudinal axis 218 of the termination barrel 216. In the illustrated embodiment, the circumference 227 of the intermediate barrel 224 is greater than the circumference 119 of the termination barrel 216. A seam 228 is formed in the intermediate barrel 224 where the edges 210 meet. In one embodiment, the seam 228 may be sealed, for example, by welding.

The mating portion 212 is rolled so that the edges 214 of the mating portion 212 are in contact with one another. The mating portion 212 is rolled into a mating barrel 230 having a longitudinal axis 232 and a circumference 233. The longitudinal axis 232 of the mating barrel 230 extends along the longitudinal axis 226 of the intermediate barrel 224. The circumference 233 of the mating barrel 230 is less than the circumference of the intermediate barrel 224. A seam 234 is formed in the mating barrel 230 where the edges 214 meet. In one embodiment, the seam 234 may be sealed, for example, by welding.

The mating barrel 230 of the contact 200 is configured to be received in the opening 128 of the mating barrel 124 of the contact 100 (each shown in FIG. 3). The mating barrel 230 of the contact 200 is inserted into the mating barrel 124 of the contact 100 so that the tip 136 of the mating barrel 124 of the contact 100 engages the intermediate barrel 224 of the contact 200. The contact fingers 114 (shown in FIG. 3) of the contact 100 engage the mating barrel 230 of the contact 200 to form an electrical connection between the contact 100 and the contact 200. For example, the contact end 132 (shown in FIG. 3) of each contact finger 114 engages the mating barrel 230 of the contact 200.

In one embodiment, the mating barrel 230 of the contact 200 may be gold-plated to inhibit corrosion and therefore improve the current carrying capability of the contact 200. The contact 200 may be gold plated while joined to the carrier strip 204 with multiple contacts 200. Accordingly, the multiple contacts 200 may be gold-plated concurrently. After gold-plating the contacts 200, the multiple contacts 200 connected to the carrier strip 204 may be concurrently inserted into the cavities 54 in the connector body 52 (both shown in FIG. 1).

Figure 6:
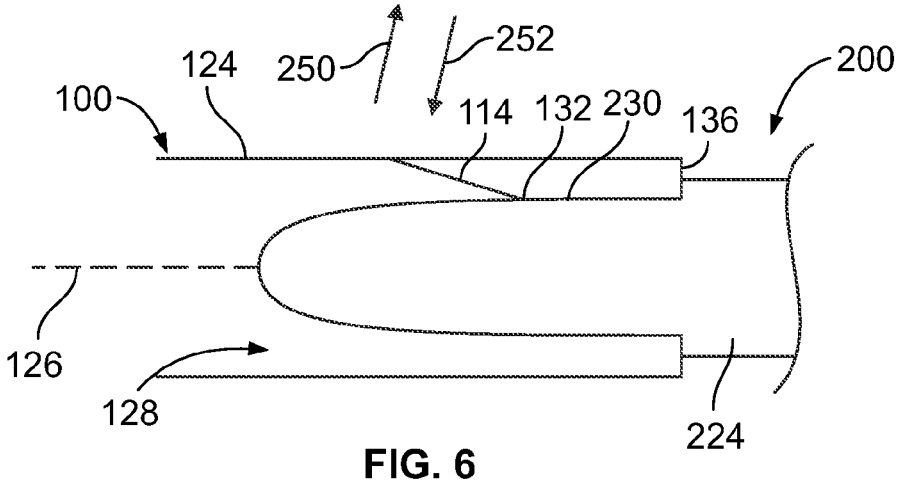
FIG. 6 is a cross-sectional view of the mating barrel of the high-reliability female contact shown in FIG. 3 coupled to the mating barrel of the high-reliability male contact shown in FIG. 5.

FIG. 6 is a cross-sectional view of the mating barrel 124 of the contact 100 coupled to the mating barrel 230 of the contact 200. The mating barrel 230 is inserted into the opening 128 of the mating barrel 124 of the contact 100. The mating barrel 230 of the contact 200 is inserted along the longitudinal axis 126 of the mating barrel 124 of the contact 100. In one embodiment, the smooth tip 136 of the mating barrel 124 of the contact 100 guides the mating barrel 230 of the contact 200 into the opening 128. The smooth tip 136 facilitates preventing the mating barrel 230 of the contact 200 from stubbing the contact fingers 114 of the contact 100. The mating barrel 230 of the contact 200 is inserted into the opening 128 until the intermediate barrel 224 of the contact 200 engages the tip 136 of the contact 100.

The contact fingers 114 of the contact 100 engage the mating barrel 230 of the contact 200. In an exemplary embodiment, the contact ends 132 of the contact fingers 114 are rounded to receive the mating barrel 230 of the contact 200. The rounded contact end 132 facilitates preventing the contact finger 114 from being stubbed when the mating barrel 230 of the contact 200 engages the contact finger 114. In an exemplary embodiment, the contact fingers 114 are springs that bend outward in the direction of the arrow 250 when engaged by the mating barrel 230 of the contact 200. The contact fingers 114 are then held against the mating barrel 230 of the contact 200 by a force in the direction of arrow 252. In one embodiment, only the contact end 132 of the contact finger 114 engages the mating barrel 230 of the contact 200. Alternatively, an intermediate portion of the contact finger between the fixed end 130 and the contact end 132 may engage the mating barrel 230 of the contact 200.

The force from the contact fingers 114 retains the mating barrel 230 of the contact 200 within the opening 128 in the mating barrel 124 of the contact 100. The contact fingers 114 provide an electrical connection between the contact 100 and the contact 200. In an exemplary embodiment, the contact 100 includes multiple contact fingers 114 to provide redundancy in the electrical connection between the contact 100 and the contact 200. In one embodiment, the contact 100 may include any number of contact fingers 114 to provide redundancy. The redundancy improves a performance of the contacts 100 and 200 by improving a flow of current between the contact 100 and the contact 200. The redundancy may also reduce a temperature in the contact 100 and/or the contact 200.

Figure 7:
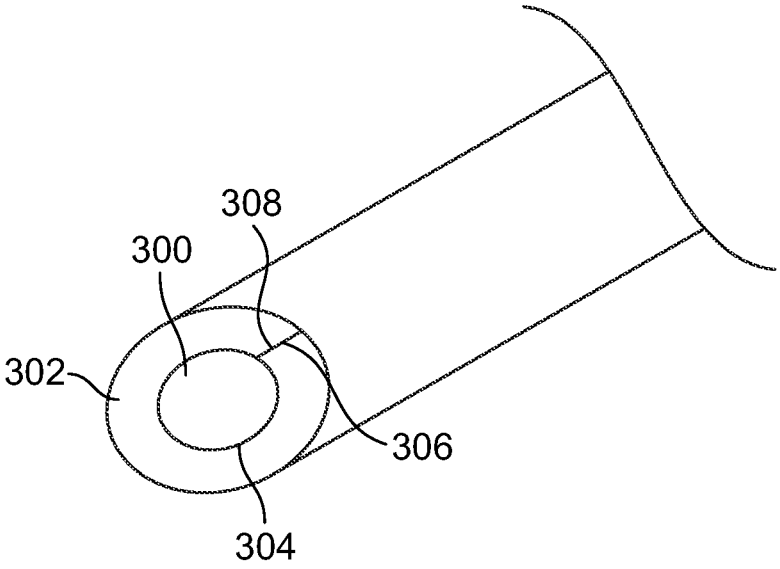
FIG. 7 is a perspective view of a termination barrel of a high reliability contact formed in accordance with an embodiment and having a sleeve positioned thereon.

FIG. 7 is a perspective view of a termination barrel 300 of a high reliability contact having a sleeve 302 positioned thereon. The termination barrel 300 may be the termination barrel 116 of the contact 100 (shown in FIG. 3) and/or the termination barrel 216 of the contact 200 (shown in FIG. 5). The termination barrel 216 is formed from a termination portion 304 having edges 306. The termination portion 304 is rolled so that the edges 306 are in contact with one another. A seam 308 is formed at the junction of the edges 306.

Because the edges 306 are not mechanically coupled, the termination barrel 300 may be crushed and/or otherwise deformed when the termination barrel 300 is indent crimped to a wire (not shown). Crushing and/or deforming the termination barrel 300 may result in a poor connection between the termination barrel 300 and the wire. The sleeve 302 is positioned over the termination barrel 300 to provide stability to the termination barrel 300 when indent crimped. The sleeve 302 facilitates preventing the termination barrel 300 from becoming crushed and/or deformed, thereby improving a connection between the termination barrel 300 and the wire. The sleeve 302 may be formed from a non-conductive metal. Alternatively, the sleeve 302 may be formed from a dielectric material, for example, rubber or the like.

Although FIG. 7 illustrates the termination barrel 300 being stabilized by the sleeve 302, the termination barrel 300 may be stabilized using other means. For example, a seam 308 in the termination barrel 300 may be welded or otherwise sealed. In one embodiment, as discussed above, the seam 308 may be laser welded to join the edges 306 of the termination portion 304.

Figure 8:
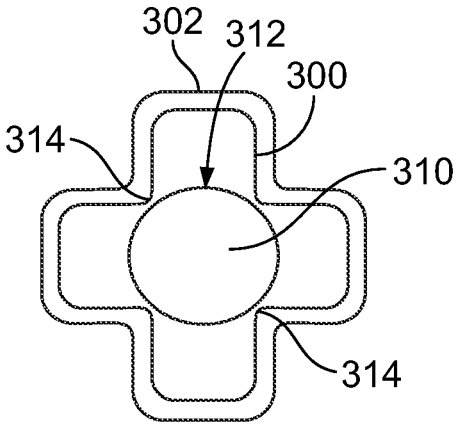
FIG. 8 is a cross-sectional view of a termination barrel of a high reliability contact formed in accordance with an embodiment that has been indent crimped to a wire.

FIG. 8 is a cross-sectional view of the termination barrel 300 having been indent crimped to a wire 310. The termination barrel 300 includes an opening 312 extending therethrough. The wire 310 is extended into the opening 312. In the illustrated embodiment, the termination barrel 300 includes the sleeve 302. The sleeve 302 provides stability to the termination barrel 300 during indent crimping. The termination barrel 300 is indent crimped to form four crimps 314 in the termination barrel 300. The crimps 314 engage the wire 310 to electrically couple the wire to the termination barrel 300. In the illustrated embodiment, the termination barrel 300 is indent crimped using a 4/8 indent crimper. Alternatively, the termination barrel 300 may be indent crimped using any suitable crimper.

The high-reliability contacts 100 and 200 are stamped and formed to increase manufacturing time and reduce costs. The contacts 100 and 200 may be produced at a rate of approximately 3000-5000 contacts per hours. Additionally, the contacts 100 and 200 require less gold-plating in comparison to conventional high-reliability contacts, thereby, reducing manufacturing costs. Further, the contact 100 does not require an additional hood, but rather incorporates the advantages of a hood into the formation of the mating barrel 124 of the contact 100. Moreover, the contacts 100 and 200 require less material and have reduced weights in comparison to machined contacts, thereby reducing manufacturing costs and operation costs when used in military, missile, satellite and aircraft applications, or the like. Additionally, the stamped and formed contacts 100 and 200 are capable of being crimped to a wire using military standard indent crimpers.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A high-reliability contact comprising:

a termination portion at a first end of the contact configured to receive a wire, the termination portion having edges;

a mating portion at a second end of the contact and formed integrally with the termination portion, the mating portion having edges, the mating portion and termination portion being stamped and formed so that the edges are rolled together at a seam to form a generally cylindrical termination barrel at the termination portion configured to receive the wire and a generally cylindrical mating barrel at the mating portion configured to receive a corresponding contact the termination barrel and mating barrel extending along a longitudinal axis of the contact between the first and second ends, the seam being continuous along the termination barrel and the mating barrel;

a sleeve positioned over the termination barrel before the termination barrel is crimped to the wire;

at least one contact finger formed in the mating barrel, the at least contact finger extending into the mating barrel toward the longitudinal axis to facilitate contacting the corresponding contact; and a contact hood formed at a distal end of the mating portion to facilitate protecting the at least one contact finger when the mating portion is coupled to the corresponding contact.

2. The contact of claim 1 further comprising multiple contact fingers formed in the mating barrel to provide redundancy when the mating portion is coupled to the corresponding contact.

3. The contact of claim 1 further comprising multiple contact fingers formed in the mating barrel to facilitate reducing heat within the contact.

4. The contact of claim 1, wherein the at least one contact finger includes a fixed end and a contact end, the fixed end extending from the mating portion into the mating barrel, the contact finger extending toward the longitudinal axis of the mating barrel so that the contact end is positioned within the mating barrel.

5. The contact of claim 1, wherein the at least one contact finger includes a fixed end extending from the mating portion into the mating barrel and a contact end configured to mate with the corresponding contact.

6. The contact of claim 1, wherein the at least one contact finger includes a rounded contact end configured to mate with the corresponding contact.

7. The contact of claim 1, wherein the contact hood extends around a circumference of the mating barrel forward of the at least one contact finger.

8. The contact of claim 1, wherein the contact hood includes a smooth outer surface to facilitate mating with the corresponding contact.

9. A high-reliability contact comprising:

a cylindrical mating portion configured to receive a corresponding contact, the mating portion has edges that are rolled together at a seam to form a mating barrel configured to receive the corresponding contact;

a cylindrical termination portion formed integrally with the mating portion, the termination portion having edges, the termination portion being stamped and formed so that the edges are rolled together at a seam to form a cylindrical termination barrel having a longitudinal axis, the longitudinal axis extending along a longitudinal axis of the mating barrel, the seam of the mating portion being continuous with the seam of the termination, the termination barrel configured to receive a wire, wherein the termination barrel is configured to be indent crimped to the wire using an indent crimper; and a sleeve positioned over the termination barrel before the termination barrel is crimped to the wire.

10. The contact of claim 9, wherein the edges of the termination portion are welded together at the seam before the termination barrel is crimped to the wire.

11. The contact of claim 9, wherein the termination barrel is coupled to a carrier strip along with multiple contacts, the multiple contacts indent crimped to a corresponding wire while attached to the carrier strip.

12. A high-reliability contact comprising:

a termination portion having edges, the termination portion being stamped and formed so that the edges are rolled together at a seam to form a cylindrical termination barrel having a longitudinal axis, the termination barrel configured to receive a wire, wherein the termination barrel is configured to be indent crimped to the wire using an indent crimper;

a mating portion formed integrally with the termination portion, the mating portion having edges, the mating portion being stamped and formed so that the edges are rolled together at a seam to form a cylindrical mating barrel having a longitudinal axis extending along the longitudinal axis of the termination portion, the mating barrel configured to receive a corresponding contact, wherein the seam is continuous along the termination barrel and the mating barrel;

a sleeve positioned over the termination barrel before the termination barrel is crimped to the wire;

at least one contact finger formed in the mating barrel, the at least contact finger extending into the mating barrel toward the longitudinal axis of the mating barrel to facilitate contacting the corresponding contact; and a contact hood formed at a distal end of the mating portion forward of the at least one contact finger, the contact hood being configured to be mated to the corresponding contact prior to the at least one contact finger.

13. The contact of claim 12, wherein the edges of the termination portion are secured together at the seam before the termination barrel is crimped to the wire.

14. The contact of claim 12, wherein the at least one contact finger includes a fixed end and a contact end, the fixed end extending from the mating portion into the mating barrel, the contact finger extending toward the longitudinal axis of the mating barrel so that the contact end is positioned within the mating barrel.

15. The contact of claim 12, wherein the at least one contact finger includes a fixed end extending from the mating portion into the mating barrel and a contact end configured to mate with the corresponding contact.

16. The contact of claim 12, wherein the contact hood extends around a circumference of the mating barrel.

17. The contact of claim 12, wherein the mating portion extends from the termination portion, the contact having a circular cross section along an entire length of the longitudinal axis.

* * * * *